United States Patent [19]

Giorgini

[11] 4,363,862

[45] Dec. 14, 1982

[54] PRESSURE-FIXING APPARATUS AND METHOD

[75] Inventor: Norman L. Giorgini, West St. Paul, Minn.

[73] Assignee: Minnesota Mining & Manufacturing Co., St. Paul, Minn.

[21] Appl. No.: 330,786

[22] Filed: Dec. 14, 1981

Related U.S. Application Data

[63] Continuation of Ser. No. 144,700, Apr. 28, 1980, abandoned.

[51] Int. Cl.[3] ..... G03G 13/20; G03G 15/20

[52] U.S. Cl. ..... 430/98; 355/3 FU; 118/114; 118/116; 100/176

[58] Field of Search ..... 430/98, 99, 124; 355/3 FU; 118/114, 116; 219/469; 432/60, 228

[56] References Cited

U.S. PATENT DOCUMENTS 3,854,975 12/1974 Brenneman et al. ..... 118/114 X
3,874,894 4/1975 Pedersen ..... 118/116 X
4,200,389 4/1980 Matsui et al. ..... 355/3 FU
4,290,691 9/1981 Giorgini ..... 430/98 X

FOREIGN PATENT DOCUMENTS 2911526 9/1979 Fed. Rep. of Germany .
14289 5/1976 France .

*Primary Examiner*—Roland E. Martin, Jr.
*Attorney, Agent, or Firm*—Cruzan Alexander; Donald M. Sell; James V. Lilly

[57] ABSTRACT

An apparatus for fixing powder images to a receptor to provide low gloss copies is provided. The apparatus comprises first and second contacting pressure members that have skewed longitudinal axes with respect to each other. The first pressure member contacts the imaged surface of a receptor and comprises an irregular, non-compliant surface comprising a plurality of randomly sized domed projections. The second pressure member contacts the unimaged surface of a receptor and comprises a compliant surface.

8 Claims, 4 Drawing Figures

PRESSURE-FIXING APPARATUS AND METHOD

This is a continuation, of application Ser. No. 144,700 filed Apr. 28, 1980, now abandoned.

FIELD OF THE INVENTION

This invention relates to electrostatic duplicating or copying apparati and processes. More particularly, this invention relates to the pressure-fixing of imaging powders to a receptor, such as a sheet of paper, and provides apparati and methods for fixing such powders to such a receptor. The resultant copies have substantially reduced gloss in image and background areas. Additionally, the images are firmly anchored to the receptor.

Electrostatic copying processes generally comprise the steps of electrostatically charging a photosensitive substrate, image-wise exposing the charged substrate to a graphic original, developing the charged image areas with imaging powder, and then fixing the powder.

Two types of processes, the "transfer process" and the "direct process", are well known. In the "transfer process", a permanent photosensitive substrate is employed and the developed image areas are transferred from it to an expendable receptor, such as paper, where the toner is then permanently fixed. In the "direct process" the substrate and the receptor are the same and comprise an expendable electrostatic copy paper to which the developed image is fixed without transfer. The present invention provides apparati and methods for pressure fixing imaging powders in both of these processes.

Pressure-flexible imaging powders become affixed to a receptor by the application of a minimum fixing pressure. Consequently, an apparatus which fixes imaging powders to a receptor by application of pressure must be capable of exerting sufficient pressure on the powder to exceed the minimum fixing pressure and cause the particles to coalesce and bond thereto. Generally pressure is applied by a pair of steel rolls known as "fusing rolls".

The fusing rolls employed in the first pressure-fixing apparati had fine (i.e., smooth) surface finishes. The fine surface finish in combination with the fixing pressures necessary to cause the developing powder particles to coalesce resulted in copies that had shiny (i.e., glossy) image and background areas. This made the copies difficult to read and aesthetically unpleasant in appearance.

Many attempts were made to eliminate these problems. One approach was to reduce the amount or pressure applied to the fixing rolls. This, however, was not entirely satisfactory. Thus, while the non-imaged (i.e., background) areas exhibited some reduction in gloss, the imaged areas exhibited virtually no reduction in gloss. Additionally, the imaged areas were less permanently fixed to the receptor surface.

Other attempts to eliminate these problems have also been made. Thus see U.S. Pat. Nos. 3,854,975 and 3,874,894. In U.S. Pat. No. 3,854,975, two cylindrical pressure members are employed. The pressure member that contacts the unfixed image is a hard surfaced metal roll whose surface is preferably smooth and non-porous. The other pressure member preferably has a surface that is softer and more compliant.

In U.S. Pat. No. 3,874,894, two cylindrical pressure members are also employed. The pressure member that contacts the unfixed image areas has a smooth and deformable surface. The other pressure member has a surface which is at least as hard as that of the first.

These approaches have not proven entirely satisfactory because the imaged surface still exhibits relatively high gloss.

Still other attempts to solve this problem are disclosed in German Patent Publication No. 28 23 359 published June 13, 1979, and German Patent Publication No. 29 11 526 published Sept. 27, 1979. These documents disclose pressure fixation devices that employ a pair of pressure members wherein the member that contacts the unfixed image areas has an irregular surface.

In the former German patent publication the irregularly surfaced pressure member comprises minute rounded peaks. This pressure member is said to contact the other pressure member. However, this publication further discloses that if there is nothing between the members, the rounded peaks will be worn away by the continued contact of the members. Consequently, it is preferred, for practical use, that the members be maintained in a spaced apart relationship. This, however, places limitations upon the physical configuration of the pressure-fixing device relative to the degree of skew that can be utilized with the pressure members. Additionally, it is clear that the two members each have hard, non-compliant surfaces.

In the latter German patent publication the surface of both pressure members is hard. The member that contacts the image areas has an "aventurine-like" surface. This surface is prepared by sandblasting a surface and then treating the surface with steel balls. The other pressure member has a hard surface which may, if desired, be "aventurine-like".

Another attempt to solve the gloss problem is described in copending application Ser. No. 84,987 filed Oct. 15, 1979 by N. L. Giorgini in J. W. U.S. Pat. No. 4,290,691. This application describes a pressure fixing device that employs two textured pressure members. The one that contacts the unfixed images has a compliant surface while the other pressure member has a non-compliant surface.

Copies produced from this apparatus have low gloss in both image and background areas. Furthermore, the images are firmly fixed to the receptor. However, it has been found that the present invention provides even lower gloss copies while still firmly anchoring the images to the receptor.

Disclosure of Invention

In one aspect, the present invention provides an apparatus for fixing unfixed image areas of pressure-fixable imaging powder on an imaged surface of a receptor that comprises (a) first and second pressure members that have skewed longitudinal axis with respect to each other and that contact each other along a narrow nip, wherein, said first pressure member has an irregular, non-compliant surface comprising a plurality of randomly sized, domed projections that contact the imaged surface of said receptor and wherein said second pressure member has a compliant surface that contacts the non-imaged surface of said receptor; and (b) means for rotating said first and second pressure members so that said receptor is transported through said nip.

In another aspect, the present invention provides a method of fixing pressure-fixable imaging powder on the surface of a receptor comprising the steps of:

(a) forming an imaged surface that comprises areas of unfixed pressure-fixable imaging powder on the surface of a receptor; and (b) passing said receptor through the nip formed by first and second contacting pressure members to fix said image areas to said receptors, said pressure members being rotated so that said receptor is transported therethrough, wherein said pressure members are as described above.

BRIEF DESCRIPTION OF THE DRAWINGS

The present invention is described in greater detail hereinafter with reference to the accompanying drawings wherein like reference characters refer to the same elements in the several views and wherein.

DETAILED DESCRIPTION

The present invention is based upon the discovery that the combination of a first pressure member (sometimes referred to hereinafter as a fixing member or fixing roll) that has an irregular, non-compliant surface and a second pressure member (sometimes referred to hereinafter as a back-up member or back-up roll) that has a compliant surface provides low gloss in image and background areas on a receptor surface while at the same time firmly anchoring the imaging powder to the receptor surface. Surprisingly, the combination of the non-compliant pressure roll with the compliant back-up roll has extended life even though the two rolls are in contact with each other when no receptor is passing therebetween. Apparently, the compliant back-up roll acts as a cushion thereby substantially eliminating wear on the non-compliant pressure roll and also preventing the domed projections from being crushed.

Preferably the pressure members are cylindrical rolls that each have a substantially circular cross-section. Additionally, it is preferred that the non-compliant surface of the first pressure member comprise a plurality of sharp peaks that have been coated with a layer of non-compliant material having a thickness in the range of from about 0.01 to 0.1 mm, and most preferably from about 0.015 to 0.08 mm, so as to provide said randomly sized domed projections. It is also preferred that these sharp peaks be coated with chrome.

The compliant surface of the second pressure member preferably is smooth and comprises a material such as nylon. However, it may be irregular if desired.

Figure 1:
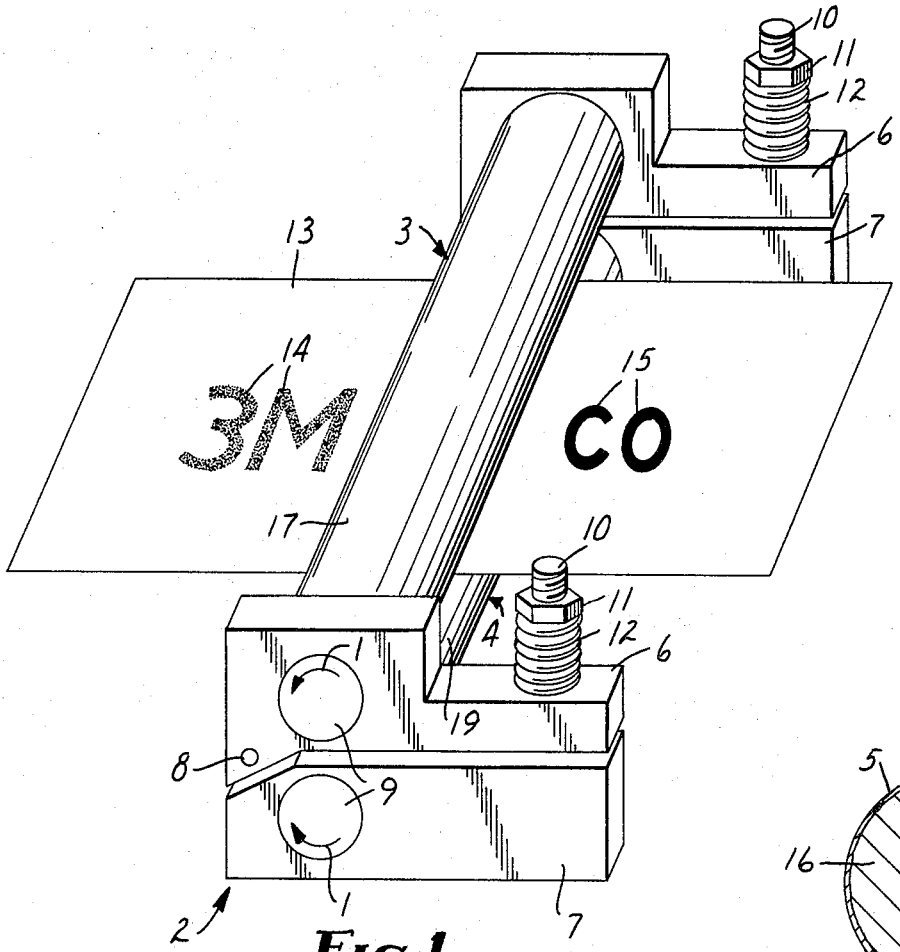
FIG. 1 is a perspective view of an apparatus according to the present invention.
Figure 3:
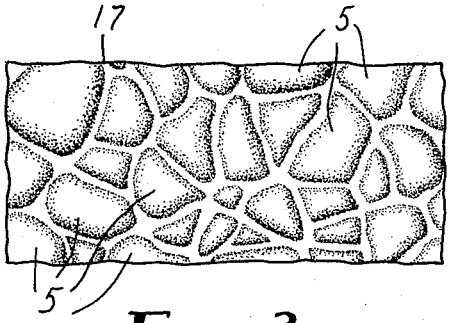
FIG. 3 is an enlargement of a section of the surface of the non-compliant pressure member of FIG. 1 showing the domed projections.

Referring now specifically to the figures, FIG. 1 illustrates an apparatus 2 for pressure-fixing imaging powder in imaged areas. The apparatus 2 comprises a first cylindrical pressure roll 3 and a second cylindrical pressure roll 4. Roll 3 has an irregular, non-compliant surface that comprises a plurality of randomly sized domed projections 5 (see FIGS. 3 and 4). Roll 4 has a compliant surface. Rolls 3 and 4 are preferably held in position by means of a split journal box that comprises an upper section 6 and a lower section 7. Pin 8 is provided in upper section 6 so that upper section 6 may be pivoted therearound to permit separation of the two sections. This permits rolls 3 and 4 to be removed if desired. Bearings 9 are also provided in each of section 6 and 7. Means for rotating rolls 3 and 4 are also provided so that a receptor may be transported through these rolls. These means are not shown.

Pressure adjusting means are also provided on the journal box. They comprise threaded posts 10, nuts 11 and spring 12. In operation, nuts 11 are tightened on posts 10 until the desired degree of compression is obtained in springs 12.

FIG. 1 further shows a receptor 13 that has unfixed image areas 14 and fixed image areas 15 thereon. The receptor 13 is situated with respect to apparatus 2 such that fixing roll 3 contacts the unfixed image areas 14 thereby forming fixed image areas 15. Back-up roll 4 contacts the unimaged surface of receptor 13. Fixing roll 3 and back-up roll 4 rotate in opposite directions with respect to each other as is shown by arrows 1 so that receptor 13 is transported through apparatus 2.

Figure 2:
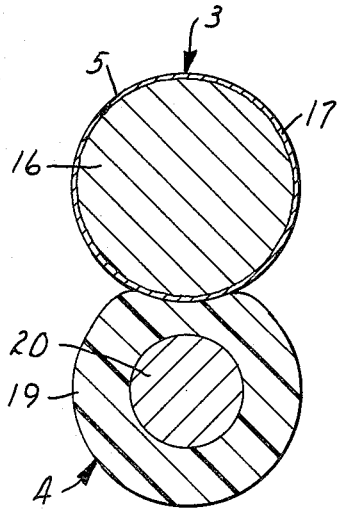
FIG. 2 is a cross sectional view of the pressure members shown in FIG. 1 showing an exaggerated degree of depression of the compliant pressure roll.
Figure 4:
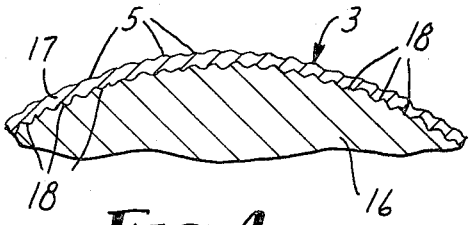
FIG. 4 is an enlarged cross sectional view of a portion of the non-compliant roll of FIG. 2.

As can be seen from FIGS. 2 and 4, fixing roll 3 comprises a rigid core 16 that has a non-compliant layer 17 therearound. Core 16 may be selected from any rigid and, preferably, non-compliant material. Metallic materials, such as steel, are especially useful.

Non-compliant layer 17 covers core 16 and provides an irregular surface that comprises a plurality of randomly sized domed projections. This layer is preferably in the range of from about 0.01 to 0.1 mm thick. Most preferably, the material of layer 17 is chrome. Layer 17 covers a surface of sharp peaks 18 on roll 3 (see FIG. 4). This layer provides the plurality of randomly sized domed projections 5 shown in enlarged size in FIG. 3.

Roll 3 may be prepared by conventional processing techniques. Thus, for example, a rigid, preferably non-compliant, cylindrical roll (such as a steel roll) may have its surface roughened by, for example, sand blasting with 100 grit abrasive material. This provides the plurality of sharp peaks 18 shown in FIG. 4. This rough surface is then coated with a non-compliant material so as to provide the randomly sized domed projections 5. This may be done by conventional plating techniques using conventional plating materials. Preferably the plating material is chrome.

FIG. 2 further shows that back-up roll 4 is preferably made up of a layer or sheath 19 of a compliant material over a central core 20. Layer 19 may be selected from any compliant material and is commonly an organic polymeric substance. A particularly useful material for use as layer 19 is nylon, especially nylon-66. Core 20 is a rigid, and preferably, non-compliant material. A variety of materials are useful as core 20. Preferably core 20 is selected from a metallic material such as steel.

Other ingredients may be incorporated into the sheath 19 of compliant material. Thus, for example, glass filled nylon may be employed if desired. Such materials are useful when the characteristics of the imaging powder and the paper to which the imaging powder is to be fixed are such that the amount of pressure required for imaging would normally induce compression set in the sheath of compliant material. Other compliant materials that may be employed to provide the compliant surface of roll 4 include hard rubber, and acetal resins.

In operation, an image comprising a plurality of unfixed pressure fixable imaging powder particles is formed on the surface of a suitable receptor. The receptor is then passed between the first and second contacting pressure members (that is between rolls 3 and 4) to fix the imaged areas to the receptor. The first pressure member contacts the imaged surface of the receptor while the second pressure member contacts the unimaged surface of the receptor. Preferably the pressure members are driven so that the receptor is transported through the nip of contact formed between the two pressure members. The resultant copy demonstrates superior quality in that the copy does not have a slick, glossy finish either in background or image areas. Consequently, the imaged surface is easy to read and aesthetically pleasing.

The present invention is further described in the following examples.

EXAMPLES 1-2

The gloss produced on paper receptors processed according to the method and using the apparatus of the present invention was compared with the gloss produced on paper receptors processed according to conventional techniques and using known equipment.

The photocopier employed in this example was VQC III LDC copier from 3M Company. The paper receptor employed was Type 3706 paper available from 3M Company. The toner powder employed was Type 371 pressure fixable toner from 3M Company.

When the present invention was used to prepare the copies (see Example 1), the standard fixing station of the copier was replaced with the device of the invention. When the known techniques and equipment were employed (See Example 2), the standard VQC III LDC fixing station was employed. This fixing station utilized smooth steel rolls.

Three separate paper receptors were processed through each machine. The first receptor was a plain white sheet. No toner was applied to it. This demonstrated the background gloss imparted to the receptor. The second receptor was toned over essentially one entire surface with toner powder and then passed through the fixing station. This demonstrated the image gloss imparted to the receptor. The third sheet was an image sheet containing toned image areas and untoned background areas.

After the copies were made, the gloss of the first and second receptors was determined with a Hunter Lab Model D-16 Multipurpose Gloss Meter available from Hunter Associates Laboratories Incorporated of Fairfax, Virginia. The angle of the incident light was 75° from vertical. The technique for measuring gloss is described in the Technical association of Pulp and Paper Industries test method T-4800os-72.

The gloss values obtained are given in Table 1. High gloss values indicate high gloss (i.e., a shiny and reflective surface) on the copy.

TABLE 1

| EXAMPLE | RECEPTOR | GLOSS |
|---|---|---|
| 1 | First (White) | 11 |
| | Second (Black) | 12 |
| 2 | First (White) | 22 |
| | Second (Black) | 43 |

This data clearly demonstrates the unexpected results achieved by practice of the present invention. Thus, the first and second receptors of Example 1 had a matte-like finish as is shown by their low gloss values. The first and second receptors of Example 2, on the other hand, had a shiny finish as is clearly shown by their high gloss values.

The third receptors of each Example even more clearly illustrate the dramatic reduction in gloss achieved by the process and apparatus of the present invention. Thus, the third receptor of Example 1 had a flat appearance (i.e., it did not reflect a great deal of light) and was easy to read. However, the third receptor of Example 2 had a glossy appearance (i.e., it reflected a great deal of light) and was difficult to read.

The preceding disclosure describes the more preferred aspects of the present invention. However, minor variations of the invention are possible and will be obvious to those skilled in the art as a result of this disclosure. These variations are included within the scope of the accompanying claims.

What is claimed is:

1. A method of fixing pressure-fixable imaging powder to the surface of a receptor comprising the steps of:

(a) forming areas of unfixed pressure-fixable imaging powder on one surface of a receptor; and (b) passing said receptor between first and second pressure members to fix said areas of unfixed pressure-fixable imaging powder to said first surface of said receptor, said pressure members being rotated so that said receptor is transported therethrough; wherein said pressure members have longitudinal axes, and wherein said pressure members are disposed to contact each other along a narrow nip, and wherein said first pressure member has an irregular, non-compliant surface comprising a plurality of randomly sized domed projections that contact said areas of unfixed pressure-fixable imaging powder on said first surface of said receptor, and wherein said second pressure member has a compliant surface that contacts the second, unimaged surface of said receptor.

2. An apparatus for fixing pressure-fixable imaging powder disposed in image areas on a first surface of a receptor that comprises (a) first and second pressure members that have longitudinal axes and that are disposed to contact each other along a narrow nip wherein said first pressure member has an irregular, non-compliant surface comprising a plurality of randomly sized, domed projections that contact the image areas on said receptor and wherein said second pressure member has a compliant surface that contacts the second, non-imaged surface of said receptor; and (b) means for rotating said first and second pressure members so that said receptor is transported through said nip.

3. An apparatus according to claim 2 wherein said pressure members have a substantially circular cross section.

4. An apparatus according to claim 3 wherein the non-compliant surface of said first pressure member comprises a plurality of sharp peaks that have been coated with a layer of non-compliant material having a thickness in the range of from about 0.015 to 0.08 mm.

5. An apparatus according to claim 4 wherein said non-compliant material is chrome.

6. An apparatus according to claim 3 wherein the surface of said second pressure member is smooth.

7. An apparatus according to claim 6 wherein the surface of said second pressure member is nylon.

8. An apparatus according to claim 2 further comprising means for providing image areas of pressure-fixable image powder on the surface of said receptor.

* * * * *